United States Patent [19]

Brackmann et al.

[11] Patent Number: 4,627,447

[45] Date of Patent: Dec. 9, 1986

[54] TOBACCO WINNOWING METHOD AND APPARATUS

[75] Inventors: Warren A. Brackmann; Stanislav M. Snaidr, both of Mississauga, Canada

[73] Assignee: Rothmans of Pall Mall Canada Limited, North York, Canada

[21] Appl. No.: 561,296

[22] Filed: Dec. 14, 1983

[30] Foreign Application Priority Data

Dec. 16, 1982 [GB] United Kingdom ..... 8235883

[51] Int. Cl.[4] ..... A24B 3/06

[52] U.S. Cl. ..... 131/109.1; 131/109.2; 131/109.3; 131/110; 131/84.3

[58] Field of Search ..... 131/108, 109 R, 109 B, 131/109 AB, 110, 84 B, 106.1, 109.2, 109.3, 109.4, 84.1, 84.2, 84.3

[56] References Cited

U.S. PATENT DOCUMENTS 3,034,514 5/1962 Pinkham ..... 131/84.3

3,138,163 6/1964 Ffoulkes ..... 131/84 B

FOREIGN PATENT DOCUMENTS 1285929 12/1968 Fed. Rep. of Germany ..... 131/110

*Primary Examiner*—V. Millin

*Attorney, Agent, or Firm*—Sim & McBurney

[57] ABSTRACT

Winnowing of shredded tobacco stem material, or other particulate tobacco material, is effected by metering the shredded stem material from a reservoir and then picking the metered flow to open and separate the particles one from another. The resulting stream of separated individual particles of shredded tobacco stem material is projected into an upwardly-flowing air stream to entrain a desired lighter fraction of the particles and carry it out of the separator device. The undesired heavy fraction falls in the separator device and is collected. The collected heavy fraction preferably is reprocessed to separate agglomerates of shredded stem material present in the heavy fraction into individual particles, which are then entrained in a second upwardly-flowing air stream which subsequently joins up with the first gas stream.

29 Claims, 1 Drawing Figure

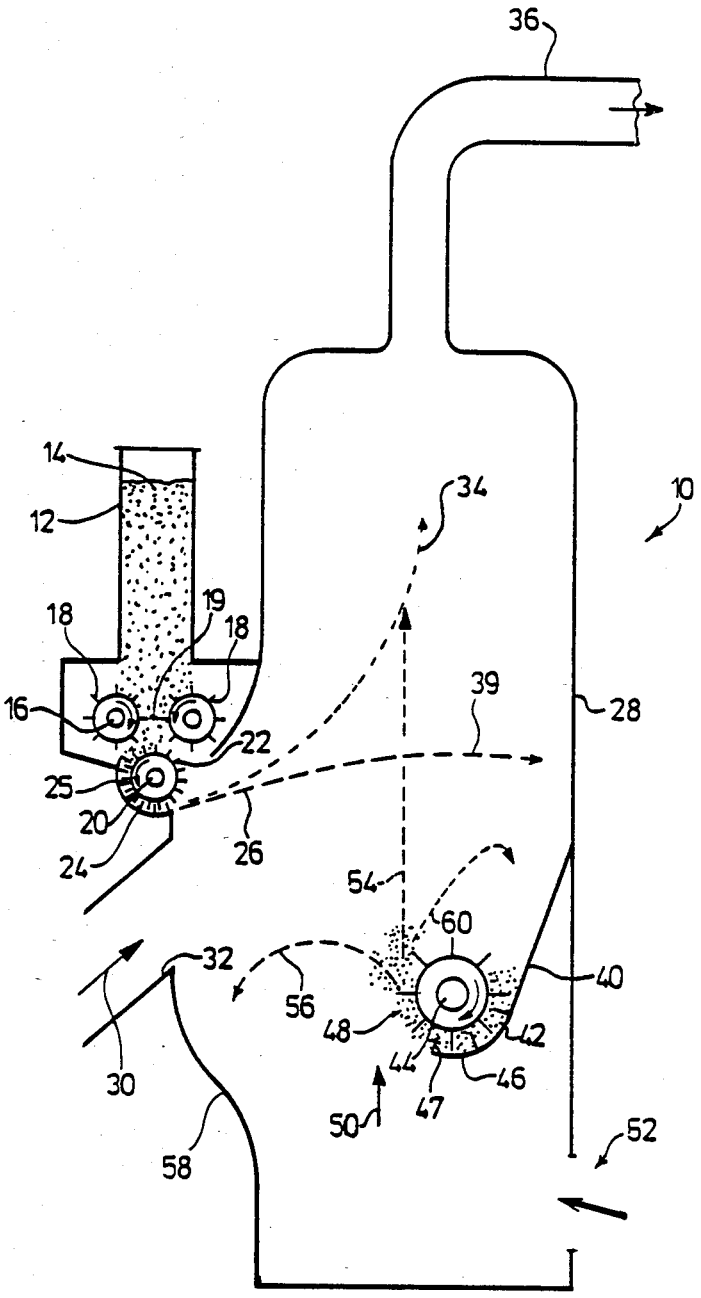
36
14
12
34
10
18
19
18
16
22
39
28
25
20
24
26
54
60
32
56
40
48
42
44
46
30
47
50
52
58

TOBACCO WINNOWING METHOD AND APPARATUS

FIELD OF INVENTION

The present invention relates to the winnowing of tobacco.

BACKGROUND TO THE INVENTION

In the processing of tobacco, there often occurs at various stages a mixture of lighter tobacco fragments and heavier tobacco fragments which require separation to permit further processing of the lighter and/or heavier fragments. Winnowing techniques of various types have been used for this purpose.

Such winnowing may be effected, for example, on threshed tobacco leaves to separate the desirable tobacco lamina from the undesirable tobacco stem material. Such winnowing also may be effected on the final blend of shredded tobacco intended for cigarette manufacture to remove unwanted stem material. Another example of winnowing is in the processing of material resulting from the cutting of whole tobacco leaves, such as described in U.S. Pat. No. 4,233,996 issued Nov. 18, 1980 to Warren A. Brackmann et al and assigned to the assignee herein, the disclosure of which is incorporated herein by reference, to separate heavier shreds of tobacco having stem portions associated therewith from lighter shreds which do not have stem portions associated therewith. Further, winnowing also is effected following threshing of the heavier shreds to separate the lamina shreds from the stem fragments.

In U.S. Pat. No. 4,386,617 issued June 7, 1983 to Warren A. Brackmann et al and assigned to the assignee herein, the disclosure of which is incorporated herein by reference, there is described a procedure for forming shredded tobacco stem material wherein tobacco stem material is fiberized between counter-rotating disc plates. The material which results usually contains heavy fragments and clusters of fibres which are unwanted in the end use of the shredded stem material and need to be removed. There is a need, therefore, for some form of separation or winnowing procedure to remove the unwanted heavy fragments and fibre clusters from the shredded stem material.

One problem which arises with existing tobacco winnowing procedures, which generally rely on gravity-induced separation of heavier particles from lighter particles in air, is that a satisfactory separation of desired material from undesired material often is not achieved, and desirable material may be lost or further processing necessary at a later stage of processing. In addition, when the undesired material is the heavy fraction, which often is the case, some heavier material which comprises agglomerations of desired lighter material forms part of the heavy fraction and hence desirable material may be lost.

One example of such material is the clusters of shredded stem material mentioned above, which are removed from the desired individual shredded stem particles along with the heavy stem fragments upon winnowing. Another example is pods of Oriental tobacco leaves which often result when opening and winnowing Oriental tobacco.

A need, therefore, exists for a tobacco winnowing procedure which will achieve substantially complete separation of lighter particles from heavier particles and will further process heavier particles which are multiple components of desired lighter particles to recover the lighter particles therein.

SUMMARY OF INVENTION

In accordance with one aspect of the present invention, there is provided a winnowing method for separating a mass of particulate tobacco material into a first fraction containing lighter tobacco particles and a second fraction containing heavier tobacco particles, wherein the mass of particulate tobacco material is introduced to a generally upwardly-flowing air stream substantially in the form of individual separated particles and the flowing air stream has a velocity sufficient to convey the lighter particles therewith but insufficient to convey the heavier particles therewith. Since the tobacco particles are presented to the flowing air stream in separated condition, each particles of tobacco is influenced by the flowing air stream in its intended manner, so that substantially-complete separation of the lighter particles from heavier particles occurs, contrary to the prior art.

As mentioned above, the heavier fraction resulting from this winnowing may contain agglomerates of lighter fraction material, as a result of the resistance of some particles to separation by the particle separation procedure prior to presentation of particles to the upwardly-flowing air stream. In accordance with another aspect of this invention, these agglomerates are collected and are subjected to further mechanical action to alter the aerodynamic characteristics of the agglomerates. After mechanical action, the agglomerate particles are exposed to an upwardly-flowing air stream, which conveys the particles upwardly, entraining separated individual particles but permitting agglomerates to be recollected and reprocessed until all the individual particles have been separated one from another and carried upwardly away in the air stream.

In another aspect of this invention, there is provided apparatus for carrying out the method aspects of the invention. A novel winnowing device comprises opening metered tobacco and projecting the tobacco into a housing through which flows an upwardly-moving air stream. Further, a novel winnowing device comprises reseparator means within a housing to effect repeated treatment of openable tobacco material to form individual particles therefrom.

GENERAL DESCRIPTION OF INVENTION

The invention is described further mainly with reference to shredded tobacco material from which the lighter fraction is the desired product, preferably shredded tobacco stem material, but also including shredded lamina material and any other tobacco material provided in the form of shreds. However, it will be understood that the invention has general application to any processed tobacco material which contains differently-weighted fractions which require separation one from another for further processing, including any of the materials discussed above.

A method in accordance with the present invention for the treatment of shredded tobacco smoking material, comprises metering shredded tobacco smoking material from a reservoir containing a mass of the shredded tobacco material; opening the shredded tobacco material particles in the metered flow to substantially separate the particles one from another, projecting the substantially separated particles into a generally upwardly flowing gas stream having a velocity sufficient to convey the desired lighter particles therewith but insufficient to convey the undesired heavier particles, and conveying tobacco material particles of the lighter fraction in their substantially separated condition in the flowing gas stream while permitting the tobacco material particles of the heavier fraction to fall in the gas stream.

By first forming a metered flow of shredded tobacco material and then picking the particles from that metered flow, substantially complete separation of the particles one from another is effected, so that the particles enter the upwardly-flowing conveying gas stream, usually an air stream, in separated form, so that winnowing into lighter and heavier fractions is readily achieved.

As noted earlier, some of the shredded tobacco material resists opening by this operation and the resulting agglomerates, or clumps of the desired material separate out of the air stream with the heavier fraction.

Since these agglomerates contain potentially useful shredded tobacco material, it is desirable that their shredded tobacco material content pass with the remainder of the desired shredded tobacco material in the conveying air stream. In accordance with a preferred embodiment of the invention, the heavier fraction collected in the above-described winnowing operation is subjected to further opening and winnowing, to open and separate the agglomerates into individual particles and to convey them in a generally upwardly-conveying gas stream, usually an air stream, to join with the conveying gas stream from the main winnowing operation. Some of the agglomerates may be so resistant to ready separation of the individual agglomerate particles one from another, as often is the case when agglomerates or clusters of shredded stem material are encountered, that several exposures to the reopening operation are required before full opening and separation of all the particles in the agglomerate one from another is achieved.

The latter reopening procedure may be effected on a mass of tobacco material containing agglomerates of tobacco particles with or without undesired heavy tobacco fragments, arising in any manner, not just as a result of the specific winnowing operation on the original mass of tobacco material. The reopening procedure may be effected on any agglomerated form of tobacco particles, including, for example, clusters of shredded stem material and pads of Oriental tobacco leaves.

The method of treating masses of tobacco material containing heavy stem fragments and shredded stem agglomerates comprises subjecting the mass to an opening operation so as to effect separation of some of the individual particles of shredded stem material in the agglomerates one from another while leaving substantially unaffected the heavy stem material fragments; entraining the separated individual particles of shredded stem material in an upwardly-flowing gas stream without entraining the heavy stem material fragments, recycling the unopened portions of the agglomerates to the separation operation; and repeating the entraining, recycling and separation operations until the agglomerates are completely separated into individual particles.

As described in our earlier U.S. Pat. No. 4,386,617, the shredded stem material is discharged from the air stream into which it is first dumped from the shredder and may be partially dried from its shredder discharge moisture level to a moisture level of about 19 to about 35 wt %, using any conventional tobacco drying equipment, such as, a rotary tumbler drier. The winnowing operation of the present invention conveniently is effected on this partially dried form of the shredded stem material, with the heavier fraction or winnowings, preferably after reseparation, being recycled to the shredder for further processing, if desired.

BRIEF DESCRIPTION OF DRAWING

The sole FIGURE of the drawing is a schematic representation of winnowing apparatus in accordance with a preferred embodiment of the invention.

DESCRIPTION OF PREFERRED EMBODIMENT

Referring to the drawing, there is illustrated therein a winnowing apparatus 10 for the winnowing of shredded stem material. The principles illustrated therein are applicable to a wide variety of tobacco materials, as described earlier. Shredded stem material for winnowing is fed to a reservoir tube 12 to form a mass 14 of shredded stem material therein containing both desired lighter particles and undesired heavier particles. Located at the lower end of the reservoir tube 12 in communication with the mass 14 are a pair of rotating metering rollers 16. Each roller has a plurality of pins 18 which project radially outwardly from the surface. The pins 18 of the rollers 16 are arranged, so that in the gap 19 between the rollers 16, the pins 18 are aligned.

The rollers 16 rotate in opposite directions, so that the pins 18 cooperate in the gap 19 between the rollers 16 to control and meter the desired quantity of shredded stem material between the rollers 16 from the mass of shredded stem material 14. The quantity of shredded stem material metered by the rollers 16 may be varied by varying the speed of rotation of the rollers.

A third roller 20 is located below and substantially equidistantly from the rollers 16 and includes radially-directed pins 22. A curved wall 24 usually having approximately the same centre of curvature as the roller 20 is provided as a guide surface for the flow of shredded stem particles in a curved path round the roller 20 while pins 25 project upwardly from the curved surface 25 towards the roller 20. The pins 22 on the roller 20 and the upstanding pins 25 interact to effect separation of individual shredded stem particles one from another as the metered flow is conveyed over the curved surface 24. As the separated stem particles reach the length of the curved surface 24, they are projected as a generally horizontally-moving stream 26 of separated tobacco stem particles into an enclosed housing 28. A set of rollers suitable for use as the rollers 16 and 20 is described and illustrated in detail in our U.K. Pat. No. 1,556,370.

An upwardly-flowing air stream 30 enters the housing 28 through an inlet pipe 32 under the influence of vacuum applied to the interior of the housing 28 and engages the horizontally moving stream 26 of separated tobacco shredded stem particles entering the housing 28. The speed of flow of the air stream 30 is adjusted to a value, so that the desired lighter particles 34, constituting a lighter fraction of the shredded stem material 14, are entrained by and carried upwardly in the air stream 30 towards a flow conduit 36 through which the vacuum is applied to the interior of the housing while remaining in their substantially separated condition, and the heavier particles 38, constituting a heavier fraction of the shredded lamina material 14, are not entrained and fall in an arcuate path 39 onto a collection surface 40.

In this way, there is produced a flowing air stream containing suspended shredded stem particles in separated condition free from unwanted improperly processed heavy stem material fragments and clusters of shredded stem particles. The winnowed tobacco particles 34 conveyed in the air stream 30 away from the winnowing device 10 in substantially separated condition in conduit 36 may be collected and used as desired, for example, for blending with shredded lamina material in accordance with the procedure of our U.K. Patent Publication No. 2,115,681, to form a blend useful in cigarette making.

A high speed picker roll 44 having radial pins 45, in cooperation with a curved surface 46 and pins 47 upstanding therefrom, serves to treat the heavy fraction collected on the surface 40 in an attempt to open and separate the aggregates of desirable stem material contained therein.

The processing of the heavy fraction 42 by the cooperating pins 45 of the roller 44 and pins 47 upstanding from the curved surface 46 forms a stream of tobacco stem particles 48 which projects from the end of the curved surface 46. This stream 48 is engaged by an upwardly flowing air stream 50, entering the housing 28 through a lower inlet opening 52 under the influence of the internal vacuum of the housing 28. The processing of the heavy fraction achieves some separation of individual particles of shredded stem material but often complete separation of the individual particles of the agglomerates is not achieved. The speed of flow of the air stream 50 is adjusted to a value so that the individual reseparated shredded stem material particles 54 are entrained by and are carried upwardly in the air stream 50, while the unwanted heavy stem fragments are substantially unaffected and the partially-treated agglomerates are carried upwardly towards the heavier stream 39. The air stream 50 with entrained tobacco stem material 54 joins the stream 34 and thence exits the housing 28 through conduit 36.

The heavy stem fragment stream 56 ultimately falls in a curved path and is collected on an inclined surface 58 on the opposite side of the housing 28 from the reseparator wheel 44, off which they are able to slide to a collection device (not shown). The heavy stem fragments so collected may be further processed in any desired manner.

The partially opened agglomerates in stream 60 become entrained under within the heavy fraction stream 39 and, in this way, are recycled to the collection surface 40, whence they are further processed. The procedure of partial opening and recycle of agglomerates is effected repetitively until all the individual tobacco stem particles of the initial agglomerates have been separated one from another.

The shredded stem material 14 which is winnowed by the above-described procedure may have any convenient moisture content. It is convenient to effect the winnowing on shredded stem material which has an intermediate moisture level requiring further drying to its final moisture level for inclusion in cigarettes, since the shredded stem material tends not to be degraded by the opening operations at such moisture level. Further, the final drying of the shredded stem material to its desired final moisture level is more efficiently conducted on particles which have been opened and separated, especially when the selective drying procedure described in our U.K. Patent Publication No. 2,117,881 is used.

SUMMARY OF DISCLOSURE

In summary of this disclosure, the present invention provides a method of opening and winnowing tobacco material to remove unwanted heavier particles, which is beneficial in providing the winnowed tobacco in an improved form for further processing and the ultimate formation of tobacco filler rod. Modifications are possible within the scope of this invention.

What we claim is:

1. A method of separating a mass of tobacco fragments and heavier tobacco fragments, which comprises:

metering tobacco fragments from a reservoir containing the mass of shredded tobacco material and having open upper and lower ends by rotating a pair of horizontally-spaced rollers located at the lower end of the reservoir about parallel axes, opening the metered tobacco fragments to provide a substantial proportion of the tobacco fragments in substantially separated condition by a third roller located below and substantially equidistantly from the axes of the pair of rollers for rotation about an axis parallel to the axes of the pair of rollers, and exposing said opened tobacco mass to a generally upwardly-flowing gas stream having a velocity sufficient to entrain the lighter tobacco fragments therein but insufficient to entrain the heavier tobacco fragments, whereby said lighter fragments are carried with the gas stream while the heavier fragments are not.

2. The method of claim 1 wherein said gas stream is air.

3. The method of claim 1 wherein said heavier tobacco fragments contain agglomerates of said lighter tobacco fragments and including further processing said agglomerates to open the same and to entrain the lighter fragments of said agglomerates in said upwardly-flowing gas stream.

4. The method of claim 1, wherein said mass of tobacco fragments is that which results from the threshing of tobacco leaves to effect separation of lamina material from stem material, and wherein said lamina material constitutes said lighter fraction and said stem material constitutes said heavier fraction.

5. The method of claim 1, wherein said mass of tobacco fragments is that which results from blending of shredded tobacco lamina material and processed tobacco stem material to form a cigarette making feed, and wherein said lighter fraction is constituted by said blended material and said heavier fraction is constituted by any unwanted stem material in the blend.

6. The method of claim 1 wherein said mass of tobacco fragments is that which results from the cutting of whole tobacco leaves to form narrow strands of tobacco, and wherein said lighter fraction is constituted by strands not having stem material associated therewith and said heavier fraction is constituted by strands having stem material associated therewith.

7. The method of claim 1 wherein said mass of tobacco fragments is that which results from threshing of strands of tobacco having lamina material joined to stem material to separate the lamina material from the stem material, and wherein said lighter fraction is constituted by said separated lamina material and said heavier fraction is constituted by said stem material.

8. The method of claim 1 wherein said mass of tobacco fragments is that which results from the shredding of tobacco lamina material, and wherein said lighter fraction is constituted by lamina shreds and said heavier fraction is constituted by tobacco stem material present in said shredded lamina material.

9. The method of claim 1 wherein said mass of tobacco fragments is that which results from shredding tobacco stem material, and wherein said lighter fraction is constituted by shredded stem material and said heavier fraction is constituted by unshredded tobacco stem material and agglomerates of shredded stem material.

10. A method of separating a mass of shredded tobacco material containing desired lighter particles and undesired heavier particles into a lighter fraction containing the desired lighter particles and a heavier fraction containing the undesired heavier particles, which comprises:

metering shredded tobacco material from a reservoir containing the mass of shredded tobacco material, opening the shredded tobacco material particles in the metered flow to substantially separate the particles one from another, projecting the substantially separated particles into a housing in which flows a generally upwardly-flowing gas stream having a velocity sufficient to convey the desired lighter particles therewith but insufficient to convey the undesired heavier particles, conveying tobacco material particles of the lighter fraction in their substantially separated condition in the flowing gas stream while permitting the tobacco material particles of the heavier fraction to fall in the housing, collecting said heavier fraction of tobacco particles in said housing, subjecting said collected heavier fraction to a further opening operation to effect separation of additional lighter fraction particles therefrom, and projecting said opened particles into said gas stream for entrainment therein.

11. The method of claim 10 wherein said shredded tobacco material is shredded stem material.

12. The method of claim 11 wherein said gas is air.

13. A method of separating a mass of shredded tobacco stem material containing desired lighter particles and undesired heavier particles into a lighter fraction containing the desired lighter particles and a heavier fraction containing the undesired heavier particles, which comprises:

metering shredded tobacco stem material from a reservoir containing the mass of shredded tobacco stem material, opening the shredded tobacco stem material particles in the metered flow to substantially separate the particles one from another, projecting the substantially separated particles into a generally upwardly-flowing gas stream having a velocity sufficient to convey the desired lighter particles therewith but insufficient to convey the undesired heavier particles, conveying tobacco stem particles of the lighter fraction in their substantially separated condition in the flowing gas stream while permitting the tobacco stem particles of the heavier particles to fall in the gas stream, collecting said heavier fraction of tobacco stem material containing agglomerates of the desired lighter particles, subjecting said collected heavier fraction to an opening operation so as to effect separation one from another of the individual particles of shredded stem material agglomerates present in said heavy fraction while leaving substantially unaffected the remainder of said heavier fraction, entraining said separated individual particles of shredded stem material in an upwardly-flowing gas stream without entraining said remainder of the heavy fraction, and mixing said gas stream having entrained particles with the first-mentioned gas stream.

14. The method of claim 13 wherein said opening of said agglomerates is effected by repeating the steps of subjecting the agglomerates to an opening operation, exposing the agglomerate to said upwardly-flowing gas stream, entraining individual particles of shredded stem material separated from the agglomerates, recollecting residual agglomerates and subjecting the residual agglomerates to further opening operation, until all the individual particles of shredded stem material have been separated from said agglomerates.

15. A method of separating a mass of tobacco material containing lighter tobacco particles and heavier tobacco particles, which comprises:

exposing said mass of tobacco material to a generally upwardly-flowing gas stream having a velocity sufficient to entrain lighter tobacco particles therein but insufficient to entrain heavier tobacco particles, collecting heavier tobacco particles not entrained in said upwardly-flowing gas stream comprising agglomerates of tobacco material containing plural numbers of individual tobacco particles, and subjecting said agglomerates to an opening operation so as to effect separation of the individual particles one from another and to entrain the separated individual particles in said upwardly-flowing gas stream.

16. The method of claim 15 wherein said agglomerates are agglomerates of shredded tobacco stem material.

17. The method of claim 16 wherein said agglomerates are associated with heavy stem material fragments, and including:

entraining said separated individual particles of shredded stem material in a generally upwardly-flowing gas stream without entraining said heavy stem fragments.

18. The method of claim 15 wherein said agglomerates are pads of Oriental tobacco leaves.

19. The method of claim 15 wherein said opening operation is effected by:

subjecting said agglomerates to mechanical action so as to alter the aerodynamic characteristics of said agglomerates by separating at least some of said individual tobacco particles therefrom, exposing the resultant agglomerates to a second upwardly-flowing air stream having a velocity sufficient to entrain and transport the individual tobacco particles and also to carry therewith for a short substantially vertical distance residual agglomerated material, merging said second air stream containing the individual tobacco particles into the first-mentioned upwardly-flowing air stream so as to entrain the individual tobacco particles therein, collecting said residual agglomerates from said second air stream;

subjecting said collected agglomerates to further mechanical action and exposing the resulting material to said second upwardly-flowing air stream, and repeating said steps of mechanical action, exposure to said second upwardly-flowing air stream, merging of said second air stream into said first-mentioned air stream and collecting residual agglomerates until all the associated tobacco particles of the agglomerates have been separated therefrom and transported away by said second air stream.

20. A winnowing apparatus for the separation of a mass of tobacco fragments containing desired lighter tobacco fragments and undesired heavier tobacco fragments which comprises:

housing means having an entraining gas stream inlet located adjacent a lower end thereof for feeding a gas to said housing means to form a generally upwardly-flowing gas stream therein of velocity sufficient to entrain said desired lighter tobacco fragments but insufficient to entrain said undesired heavier tobacco fragments, a tobacco fragment stream inlet located above said gas stream inlet for feeding a stream of substantially separated fragments of tobacco into said substantially upwardly-flowing gas stream, and an upper outlet located adjacent an upper end of said housing means for withdrawal of the gas stream having the entrained lighter fraction therein in substantially separated condition;

reservoir vessel means for holding a mass of said tobacco fragments and having open upper and lower ends;

metering means in fluid flow communication with the lower end of said reservoir means for metering tobacco fragments from said lower end across the whole width thereof; and opening and projecting means for opening the metered tobacco fragments and separating the fragments one from another, and subsequently projecting said separated fragments through said tobacco fragment stream inlet into said substantially upwardly-flowing gas stream.

21. A winnowing apparatus for the separation of a mass of tobacco fragments containing desired lighter tobacco fragments and undesired heavier tobacco fragments, which comprises:

housing means having an entraining gas stream inlet located adjacent a lower end thereof for feeding a gas to said housing means to form a generally upwardly-flowing gas stream therein of velocity sufficient to entrain said desired lighter tobacco fragments but insufficient to entrain said undesired heavier tobacco fragments, a tobacco fragment stream inlet located above said gas stream inlet for feeding a stream of substantially separated fragments of tobacco into said substantially upwardly-flowing gas stream, and an upper outlet located adjacent an upper end of said housing means for withdrawal of the gas stream having the entrained lighter fraction therein in substantially separated condition;

reservoir vessel means for holding a mass of said tobacco fragments and having open upper and lower ends;

metering means in fluid flow communication with the lower end of said reservoir means for metering tobacco fragments from said lower end across the whole width thereof, said metering means comprising a pair of horizontally-spaced rollers located at the lower end of said reservoir means and arranged for rotation about parallel axes to meter tobacco fragments from the lower end of said reservoir vessel means; and opening and projecting means for opening the metered tobacco fragments and separating the fragments one from another, and subsequently projecting said separated fragments through said tobacco fragment stream inlet into said substantially upwardly-flowing gas stream, said opening and projecting means comprising a third roller located below and substantially equidistantly from the axes of the pair of rollers for rotation about an axis parallel to the axes of said pair of rollers and having radially-projecting pins to open the metered fragments and project the resulting individual fragments through said fragment stream inlet.

22. The apparatus of claim 21 including a guide surface of centre of curvature corresponding to that of the third roller located in cooperative relationship with the radially-projecting pins to guide the tobacco fragments to said fragment stream inlet, and a plurality of pins upstanding from said guide surface to cooperate with the pins of said third roller to effect said opening and separation of said tobacco fragments, said guide surface terminating at said inlet in a direction such that said particle stream is projected into said housing means in a generally horizontal direction.

23. A winnowing apparatus for the separation of a mass of tobacco fragments containing desired lighter tobacco fragments and undesired heavier tobacco fragments, which comprises:

housing means having an entraining gas stream inlet located adjacent a lower end thereof for feeding a gas to said housing means to form a first generally upwardly-flowing gas stream therein of velocity sufficient to entrain said desired lighter tobacco fragments but insufficient to entrain said undesired heavier tobacco fragments, a tobacco fragment stream inlet located above said gas stream inlet for feeding a stream of substantially separated fragments of tobacco into said substantially upwardly-flowing gas stream, and an upper outlet located adjacent an upper end of said housing means for withdrawal of the gas stream having the entrained lighter fraction therein in substantially separated condition;

reservoir vessel means for holding a mass of said tobacco fragments and having open upper and lower ends;

metering means in fluid flow communication with the lower end of said reservoir means for metering tobacco fragments from said lower end across the whole width thereof; and opening and projecting means for opening the metered tobacco fragments and separating the fragments one from another, and subsequently projecting said separated fragments through said tobacco fragment stream inlet into said substantially upwardly-flowing gas stream; and reseparator means located in said housing for effecting opening of particulate tobacco material agglomerates included in said heavy fraction to separate additional light fraction fragments therefrom.

24. The apparatus of claim 23 wherein said reseparator means comprises collecting surface means for collecting said heavy fraction, picker roll means for engaging the collected heavy fraction to effect at least partial opening, of agglomerates of said desired lighter fragments and separation one from another of the individual desired lighter fragments in the agglomerates, and gas feed means for feeding a generally upwardly-flowing gas stream in the vicinity of said picker roll means to entrain said separated individual particles without entraining any other component of said heavy fraction.

25. A winnowing apparatus for the separation of a mass of tobacco fragments containing desired lighter tobacco fragments and undesired heavier tobacco fragments, which comprises:

housing means having an entraining gas stream inlet located adjacent a lower end thereof for feeding a gas to said housing means to form a first generally upwardly-flowing gas stream therein of velocity sufficient to entrain said desired lighter tobacco fragments but insufficient to entrain said undesired heavier tobacco fragments, a tobacco fragment stream inlet located above said gas stream inlet for feeding a stream of substantially separated fragments of tobacco into said substantially upwardly-flowing gas stream, and an upper outlet located adjacent an upper end of said housing means for withdrawal of the gas stream having the entrained lighter fraction therein in substantially separated condition;

reservoir vessel means for holding a mass of said tobacco fragments and having open upper and lower ends;

metering means in fluid flow communication with the lower end of said reservoir means for metering tobacco fragments from said lower end across the whole width thereof; and opening and projecting means for opening the metered tobacco fragments and separating the fragments one from another, and subsequently projecting said separated fragments through said tobacco fragment stream inlet into said substantially upwardly-flowing gas stream;

reseparator means located in said housing for further processing said heavy fraction to separate additional light fraction fragments therefrom, said reseparator means comprising collecting surface means for collecting said heavy fraction, picker roll means for engaging the collected heavy fraction to effect at least partial opening of agglomerates of said desired lighter fragments and separation one from another of the individual desired lighter fragments in the agglomerates;

gas feed means for feeding a second generally upwardly-flowing gas stream in the vicinity of said picker roll means to entrain said separated individual particles without entraining any other component of said heavy fraction;

a guide surface of centre of curvature corresponding to that of the picker roll located in cooperative relationship with the picker roll to project the heavy fraction treated thereby in an upwardly arcuately-curved path into said second generally upwardly-flowing gas stream; and pins upstanding from said guide surfaces to cooperate with the pins of the picker roller to effect said at least partial opening and separation of the fragments of said agglomerates.

26. In a winnowing apparatus comprising an enclosed housing, means for projecting particulate tobacco material into a generally upwardly-flowing gas stream in said housing to entrain lighter particles while heavier particles fall in the housing and are collected in said housing as a heavier fraction which contains tobacco material agglomerates, the improvement which comprises separator and projection means within said housing for effecting opening of particulate tobacco material agglomerates included in said heavier fraction and for projecting said opened tobacco material into said gas stream within said housing.

27. The apparatus of claim 26 wherein said separator and projection means comprises a rotatable picker roll and a curved surface located below and adjacent the picker roll whereby said heavier fraction passes therebetween.

28. The apparatus of claim 27 wherein said curved surface forms the extension of a downwardly inclined collector surface on which said heavier fraction is collected and from which it is fed to the picker roll by gravity.

29. The apparatus of claim 27 wherein said curved surface has a plurality of pins upstanding from the surface thereof and projecting into cooperative relationship with the pins of the picker roll to effect said opening of said agglomerates.

* * * * *